United States Patent [19]

Arrasmith et al.

[11] 4,065,123

[45] Dec. 27, 1977

[54] APPARATUS FOR STACKING DOCUMENTS IN SEQUENCE

[75] Inventors: Fred Victor Arrasmith, San Jose; Donald George Bruns, Saratoga; John Stuart Moffitt, San Jose; Stanton Kline Moss, Gilroy, all of Calif.

[73] Assignee: International Business Machines Corporation, Armonk, N.Y.

[21] Appl. No.: 746,760

[22] Filed: Dec. 2, 1976

[51] Int. Cl.[2] ..... B65H 31/06

[52] U.S. Cl. ..... 271/215; 93/93 C; 271/178

[58] Field of Search ..... 271/215, 214, 213, 217, 271/177, 178, 179, 180, 181; 93/93 C; 214/7

[56] References Cited

U.S. PATENT DOCUMENTS

| | | | |
|---|---|---|---|
| 2,797,098 | 6/1957 | Brodie | 214/7 |
| 2,872,190 | 2/1959 | French | 271/214 |
| 3,001,789 | 9/1961 | Emslie et al. | 214/7 UX |
| 3,892,168 | 7/1975 | Grossman | 93/93 C |
| 3,994,487 | 11/1976 | Wicklund | 271/213 X |

FOREIGN PATENT DOCUMENTS

| | | | |
|---|---|---|---|
| 946,734 | 6/1949 | France | 271/178 |

*Primary Examiner*—Bruce H. Stoner, Jr.
*Attorney, Agent, or Firm*—George E. Roush

[57] ABSTRACT

Documents are stacked on edge on a bed assembly having a backplate assembly near one end and a slidable backstop assembly aranged to be incremented away from the backplate assembly as the documents fill the stacking space therebetween. The backstop assembly is fixed to and alternately freed from the bed assembly by an escapement assembly coupled therebetween and actuated electrically. Preferably the escapement assembly comprises a pawl and ratchet together with cogged or spurred belts guiding the backstop assembly along the bed assembly. A photoresponsive, or like, assembly is arranged to sense the entrance of documents into the stacking space, and electric reed switches and corresponding actuating magnets are assembled on the backstop and bed assemblies for predetermining an initial increment of stacking space. Electric control circuitry is connected to the photoresponsive assembly and the reed switches and to the escapement assembly for actuating the latter in successive steps as the documents fill the stacking space. Preferably, the electric control circuitry is arranged to count pulses representative of individual documents encountered in the interval in which the initial increment of stacking space is filled. This count is transferred to counter circuitry for storing a number proportional to the number of documents originally counted, which stored number is used subsequently for actuating the escapement assembly and advancing the backstop assembly as subsequent documents are received.

20 Claims, 2 Drawing Figures

APPARATUS FOR STACKING DOCUMENTS IN SEQUENCE

The invention relates to apparatus for stacking documents, particularly as they emerge from a document processing machine, and it particularly pertains to apparatus for stacking documents on edge in a predetermined sequence and in a document stack from which the first documents stacked may be removed first without interrupting the flow of documents into the stacking apparatus.

THE PRIOR ART AND THE INVENTION

There are a great number of document stacking machines in the prior art, and many of them have been in satisfactory service for many years. As is usually the case, new applications in which the stacking of documents is involved point out inadequacies of prior art machinery. In accordance with pertinent requirements emanating from a design of machinery for a new document processing application, the apparatus according to the invention is arranged for the entry of sheets into a stack without interference from preceeding sheets; for the temporary stiffening of sheets for guiding them in their entry to the stack; for the stacking of sheets on edge in order, so that they may be removed in the same order while the stacking process continues; for preserving stack integrity with very large numbers of sheets; and for adding documents to the stack while simultaneously moving the stack and sensing when and how much motion is required. The arrangement according to the invention does not interfere with machines having arrangements included for offsetting sheets as stacked.

The objects of the invention indirectly referred to hereinbefore and those that will appear as the specification progresses, obtain according to the invention by a novel combination of mechanical and electric circuit components constructed separately in accordance with well known principles and assembled in novel manner in accordance with the invention.

SUMMARY OF THE INVENTION

In accordance with the invention, the documents are stacked on edge on a bed assembly having a predetermined slope from the horizontal and fitted with a backplate assembly near the higher end and a slidable backstop assembly arranged to be incremented away from the backplate assembly as the documents fill the stacking space therebetween. The backstop assembly is fixed to and alternately freed from the bed assembly by an escapement assembly coupled therebetween and actuated in accordance with the demand for stacking space, preferably, by electrically actuated control means. In a preferred embodiment, the escapement assembly comprises a dual pallet pawl and ratchet assembly for controlling the movement of a plurality of cogged or spurred endless belts on which the documents are stacked and which guide the backstop assembly down the slope along the bed assembly. A sensing assembly, preferably light source and photoresponsive devices, is arranged to sense the entrance of documents into the stacking space, and electromagnetic components are assembled on the backstop and bed assemblies for determining the limits of an initial increment of stacking space. Electric control circuitry is connected to the photorespective assembly and electric switches for delivering control electric signals to the escapement assembly in successive steps as the documents fill the stacking space. Preferably, the electric control circuitry is arranged to count pulses representative of individual document encountered in the interval in which the initial increment of stacking space is filled. This count is transferred to counter circuitry for storing a number proportional to the number of documents originally counted, which stored number is used subsequently for actuating the escapement assembly and advancing the backstop assembly as a series of documents continues to be received.

BRIEF DESCRIPTION OF THE DRAWING

In order that full advantage be obtained in the practice of the invention, a preferred embodiment thereof, given by way of example only, is described in detail hereinafter with reference to the accompanying drawing, forming a part of the specification, and in which.

DESCRIPTION OF THE PREFERRED EMBODIMENT

Figure 1:
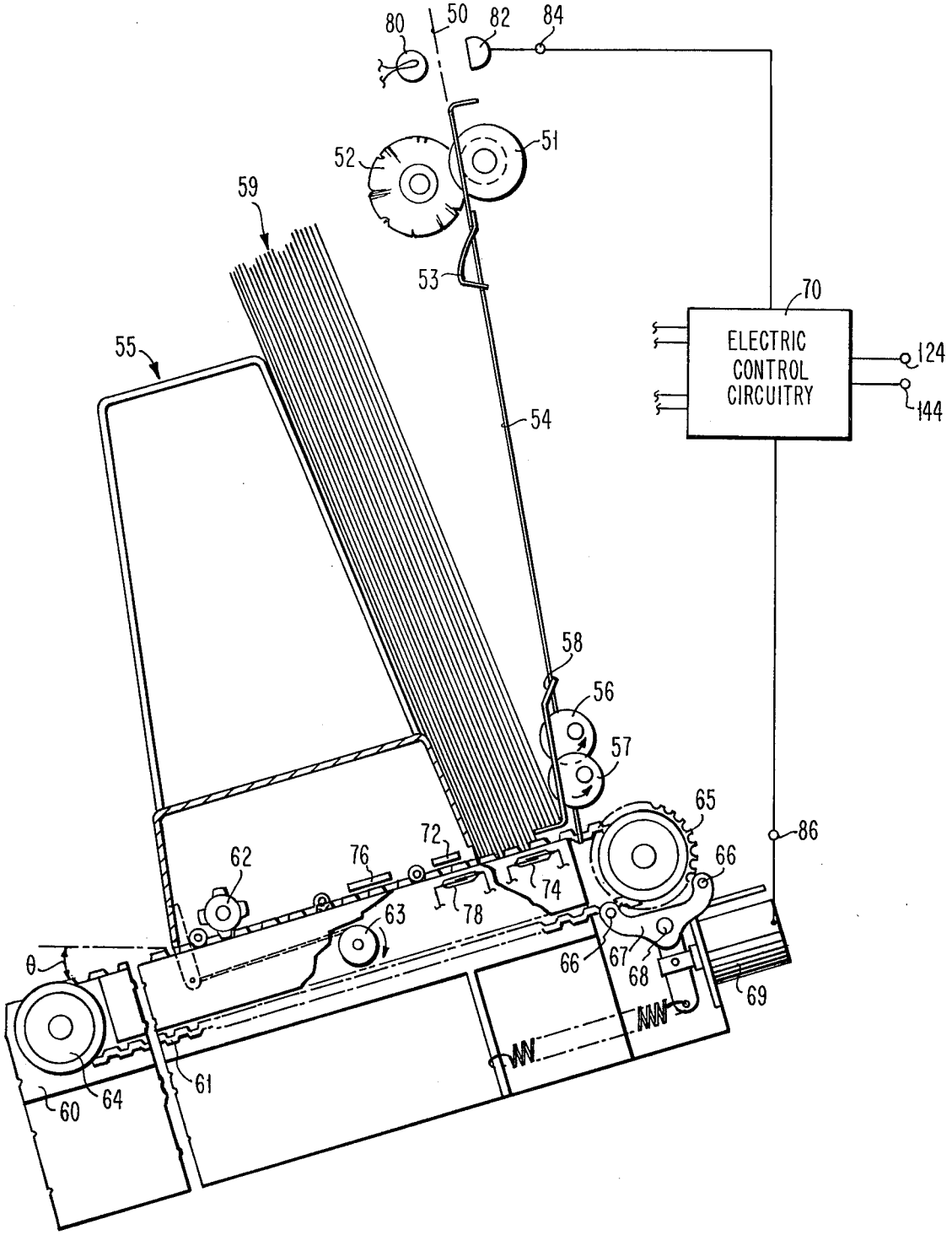
FIG. 1 is a schematic diagram illustrating the principles of apparatus for stacking documents in sequence and on edge according to the invention.

FIG. 1 depicts the essentials of apparatus according to the invention comprising an assembly of more or less readily available machine elements and electric control circuitry arranged for accepting documents in the form of sheets, such as issue from the output of a continuous forms burster, and stacks them on edge in such a manner that the first sheets stacked may be removed from the stack first. Furthermore, such removal may be accomplished while stacking continues without interruption.

The sheets enter the stacker edge first along a line 50 and pass through a pair of cooperating rolls 51 and 52 shown in FIG. 1. The roll 51 is undercut alternately along its length which divide it into sections of larger and smaller diameters. The other roll 52 is made of a conforming fuzzy, bristle-like material, such as a soft fiber, and resembles a brush. The roll 52 is engaged to the roll 51 such that the incoming sheet, under pressure from the roll 52 is temporarily "corrugated" by the alternately varying diameters of the roll 51. This temporary corrugation stiffens the sheet in the direction of travel allowing it to be driven past a plurality of springs 53 arranged across a backplate 54 in parallel relationship to each other whereby only one of which is visible in this view. The term "backplate" as used hereinafter is construed to include a multiple of parallel wires and the like arranged in a plane, which act in the same manner as the historically conventional solid plate. This corrugating effect brought about by the roll 51 imparts sufficient stiffness to the documents for deflecting these springs 53 without significantly altering the path of the sheet. The rolls 51 and 52 continue to drive the sheet until the trailing edge of the sheet passes through and out of engagement. When the trailing edge of the sheet comes out of engagement with the rolls 51 and 52, the sheet is no longer able to hold the springs 53 in their deflected state. The springs 53 return to their normal undeflected state, pushing the trailing end of the sheet as they do so. As the trailing end of the sheet is pushed over, the trailing edge of the sheet comes into engagement with the fuzzy surface of the roll 52. The roll 52 moves the trailing edge of the sheet to a position out of the way of the leading edge of the next incoming sheet and also blocks any tendency to return.

The leading edge of a sheet, after deflecting the springs 53, is guided by the backplate 54 on one surface and on the opposite surface by a backstop 55 in the case of the first sheet, or by the just previously stacked sheet in all other cases. The leading edge of the sheet passes a pair of cams 56 and 57 and is stopped by a toeplate 58. The cams 56 and 57 are driven in phase with each other but may be entirely asynchronous with respect to the arrival of the sheets being stacked. The toeplate 58 provides a guiding action around the cams 56 and 57 which controls the highest point that the leading edge of the sheet can contact the cams 56 and 57. The lower portion of the toeplate 58 consists of a ledge on which the most recently stacked part, approximately 2.5 cm (1 inch), of a document stack 59 rests.

The cams 56 and 57 push the leading end of the sheet over to the stack. The alternate lift and fall of the cams 56 and 57 packs the lower portion of the stack 59 on the lift, and allows entry of the next sheet on the fall. The rotational speed and shape of the cams 56 and 57 is such that the stack 59 can spring back only slightly during the fall of the cams 56 and 57 and the duration of the push on stack 59 is short enough that should a leading edge of a sheet arrive during its duration, buckling of the sheet will accommodate the slight delay of the leading edge while the bulk of the sheet maintains its velocity. This buckling is such that as the push from the cams 56 and 57 ends, the leading edge of the sheet will resume its motion past the cams 56 and 57.

The stack 59 is supported on a bed 60, as is the backstop 55 which is engaged to belts 61 (there are a plurality of identical belts spaced across the bed 60 of which only one is visible in this view) by a clutched wheel 62 having a configuration complementary to the belt 61. The bed 60 is arranged at an angle, preferably of the order of 15°, whereby a force is constantly applied to the stack 59 by gravity (through other means are employed as an alternative) which tends to move the stack 59 along the bed 60 away from the toeplate 58. The movement of stack 59 in response to this force is controlled by the backstop 55, the belt 61, the clutched wheel 62, a negator spring 63, and electric control circuitry 70 as will be described more fully hereinafter. The bottom edge of the stack 59, except for that portion sitting on the ledge of the toeplate 58, is engaged to the belt 61. As sheets are stacked it is necessary for the stack 59 and the backstop 55 and the belt 61 to move to provide room for the newly arriving sheets.

In the application described, it is desirable that sheets of different thickness be accommodated from time to time, however, the thickness of sheets within each batch will vary only slightly. At the start of a batch, the stacker is emptied and the backstop 55 is returned to its starting position near the toeplate 58, just out of reach of the cams 56 and 57. The electric control circuitry 70 includes electric switch means, shown here as a magnet 72 arranged on the backstop 55 and associated reed switch 74 arranged on the bed 60, which arrangement senses that the backstop 55 is in an initial position. As sheets are stacked, the backstop 55 and the belt 61 are allowed to move more frequently than might otherwise be deemed normal, until the stack 59 has reached a size such that the backstop 55 has reached a predetermined second position sensed by means shown here as a longer magnet 76 and another associated reed switch 78 similarly arranged as the short magnet and reed switch are. Mechanically actuated electric swithches are applicable should double throw contact structure be desired. The reed switches are free of environmental influence, however. A lamp 80 and a photosensitive device 82, for example a photodiode, arranged on opposite sides of the throat through which the document sheets pass, form means for sensing each document as it enters and as it passes through into the stacker, and delivering a pulse of current to suitable terminals 84. The electric control circuitry 70 counts the number of sheets required to build the stack 59 to this predetermined size. This counted number is stored as is, or preferably as divided by a predetermined number, and the quotient is the increment number. When the backstop 55 reaches its predetermined second position and the increment number is calculated, the control means continues to count the sheets as they are stacked and allows the backstop 55, the stack 59, and the belt 61 to move a predetermined distance each time the increment number of sheets has been stacked. The size of the sample stack is 3.25 centimeter (1.28 inches), the increment is number 13, and the fixed increment distance is 0.25 centimeters (0.10 inches) in an embodiment tested but these sizes and proportions may be changed to meet varying requirements. If sheets of a different thickness are to be run, the stacker is unloaded and the procedure repeated with the new sheets of different thickness.

The bed 60 which carries the belts 61, the cams 56 and 57, the toeplate 58, the backstop 55, and parts of the electric control circuitry preferably are movable up and down as a unit relative to the backplate 54 to accommodate the stacking of sheets of different heights. The operating position for sheets of any height is such that the sheet must buckle somewhat when the leading edge is on the ledge of the toeplate 58 and the trailing edge is moved by the brushly roll 52. When the sheet subsequently straightens after release by the latter roll 52, the sheet is then too high to fall back under this roll 52. The bed 60 and the parts which are affixed alternately are movable for varying the angle $\theta$ to accommodate stacking of different kinds of sheets if desired. The coefficient of friction for most documents is just overcome at an angle of the order of 16°, and the need for varying the angle is not great.

Sheets may be unloaded from the back of stack 59 by an operator reaching into the stack 59 and supporting it while the sheets nearest the backstop 55 are removed. The backstop 55 is allowed to move with respect to the belt 51 by clutch means 62 in a direction toward the stack 59 only. When the sheets are removed, the backstop 55 is moved to the back of the stack 59. If properly done, such that the attitude of the stack 59 remains nearly as it was before the removal, this unloading may be accomplished while stacking is in progress.

The belts 61 and the backstop 55 assures that the stack 59 moves down the bed 60 as a composite body, the belt cogs or spurs prohibiting bottom edges of sheets from sliding to the rear. The cams 56 and 57 also act on the composite body of the stack 59 to prohibit excessive curvature (slump) of the sheets toward the backplate 54 which could generate pressure against the latter so as to impede sheet entry motion; thus maintaining a more or less constant condition of a restrained but open throat or slot for sheet entry along the backplate 54.

The belts 61 ride on wheels 64, at least one of which has a peripheral configuration complementary to the cogged or spurred belt 61, which frequently is referred to as a "double sided timing belt" whereby those skilled in the art will readily appreciate the structure. The (one) wheel 64 is mechanically connected to a ratchet wheel 65 for rotation therewith. The ratchet wheel 65 is one element of an intermittent motion escapement device having cooperating pallets 66 engaging the ratchet wheel 65 and carried by a double-ended pawl 67 supported on a pivot pin 68 arranged on the bed 60. The pawl 67 is biased, as by a spring as shown, and moved by an electric solenoid 69 having one terminal of the electrical coil connected to terminals 86. It should be understood that the solenoid 69, the photosensitive element 82, and like electric current operated components may have a common connection to the metallic or other electric current carrying parts of the machine which have beem omitted in the drawing in the interest of simplicity, which those skilled in the art will readily appreciate.

Figure 2:
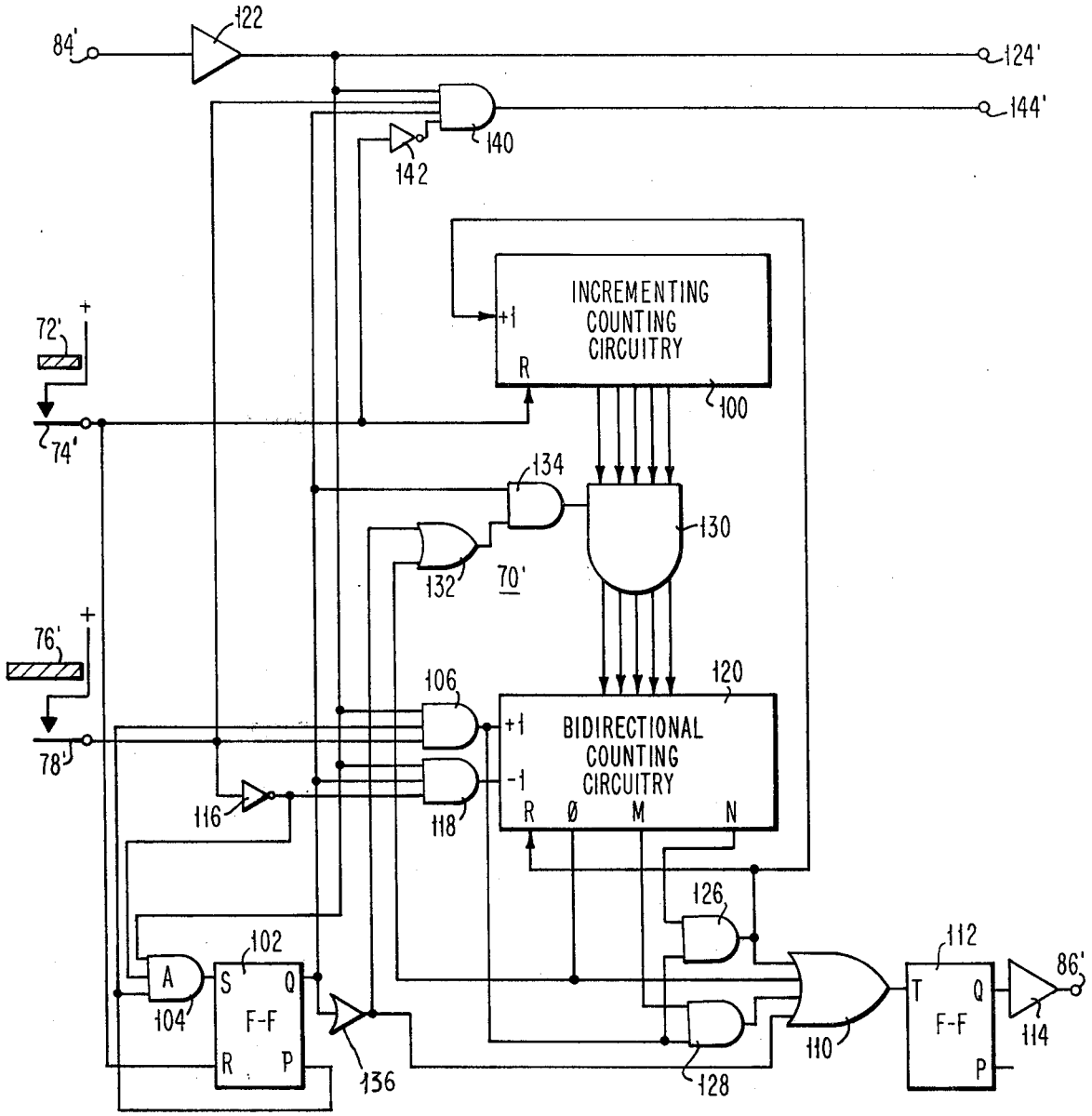
FIG. 2 is a logical functional diagram of the electric control circuitry according to the invention which is illustrated only generally in the previous figure.

A logical circuit diagram illustrating the functions of the electric control circuit 70 is shown in FIG. 2. The control circuit 70' is arranged for operation in three modes, namely, a starting mode, a sampling mode and a metering mode, with the acceptance of documents into the stacking space in all three modes. In the starting mode, all necessary resetting and extra stepping is effected as required until the backstop has moved through the 3.25 cm (1.28 inch) sampling area. In the sampling mode, the number of documents actually in process is counted with the view of determining the number of sheets that will fill each 0.25 centimeter (0.10 inch) advance of the stacker. In the metering mode thereafter, the stacker is permitted to advance everytime that number of sheets has entered the stacking space.

The change from mode to mode is effected by the operation of simple electric switches. The control circuit 70' is shown with one input reed switch 74' as actuated by a short magnet 72' for applying positive potential to reset terminals of incrementing counting circuitry 100 and a bilateral flip-flop circuit 102. The length of this magnet 72' determines the starting mode. The complementary P ($\overline{Q}$) output terminal of the flip-flop circuit 102 is applied to AND gating circuits 104 and 106 for arming the same for the successive operations to follow. The output terminal of the OR gating circuit 110 is connected to a monostable flip-flop circuit 112 for delivering a drive pulse of proper time duration to a solenoid driver circuit 114, the output of which supplies the necessary current to the solenoid at output terminal 86'. The other input reed switch 78' is actuated by a longer magnet 76' and determines the extent of the sampling mode. The positive potential at this switch 78' is applied to the AND gating circuit 106 for enabling the same and by means of an inverting circuit 116 is applied to another AND gating circuit 118 for disarming the same when the read switch 78' is closed. The AND gating circuits 106 and 118 have the output terminals therefore connected to the incrementing and decrementing input terminals of bidirectional counting circuitry 120. The output of the photosensitive device appears at input terminal 84' and is amplified and preferably also shaped, in an amplifying circuit 122. The output pulses from the amplifying circuit 122 are passed to output terminals 124 for use in other circuits, such as a document processor which will ultimately deliver documents to the document stacker of the invention. The pulse output from the amplifying circuit 122 is applied to the AND gating circuit 106 for actuating the same for counting the number of sheets entering the stacker connected to the counting circuitry 120. It should be noted that the counting circuitry 120 is not reset for this operation whereby it may contain any number from zero to N. However, at this starting period, both switches 74' and 78' are closed and the incrementing circuitry 100 also remains in the reset condition until the overlap of the switches is overcome at the opening of the reed switch 74'. Thus there will be a few sheets standing on the toeplate of the stacker at the beginning of the sampling operation, but these sheets will not affect the operation as will be seen.

Because the backstop must move during the starting and sampling periods before the increment number of sheets for each step has been calculated, the stacker is freed more often than otherwise might be deemed necessary. The backstop may or may not move depending on the paper pressure on the backstop. Also, because the backstop cannot be positioned precisely with the stacker empty, the starting electric switch 74' remains closed with between 0.32 and 0.64 cm ($\frac{1}{8}$ and $\frac{1}{4}$ inch) of paper in the stacker. The sampling electric switch 78' overlaps the entire starting switch. The sampling area where the calculation of the increment number takes place, is therefore between the points where the two switches successively open, or where the area in which the switch 78' only is closed. The bidirectional counting circuitry 120 in the sampling modes thus counts the number of sheets up to a predetermined number N, which in one practical application ranges between 13 and 16. The output of the counting circuit 120 at this time is applied to an AND gating circuit 126 for passing a pulse to the OR gating circuit 110 thereby delivering an output at the terminals 86' for freeing the backstop for additional forward motion. At this time, the bidirectional counting circuitry is reset by the output of the AND gating circuit 126 connected to the reset terminals of the counting circuitry 120. At the same time, the output of the AND gating circuit 126 is applied to the incrementing input terminals of the incrementing counting circuitry 100. Therefore, the incrementing counting circuitry 100 is arranged to hold a number that is 1/N of the number of sheets that has been counted in the stacker. In order to make sure that the backstop is sufficiently free during the starting and sampling periods, outputting terminal levels at one or more intermediate numbers as counted by the counting circuitry 120 are applied to one or more AND gating circuits. In the interest of clarity, only one such gating circuit 128 is shown for applying a pulse to the multiple OR gating circuit 110 for operating the solenoid.

Count outputting terminals of the incrementing counting circuitry 100 are coupled to count inputting terminals of the bidirectional counting circuitry 120 by means of conventional loading gating circuitry shown here as a multiple gate 130 for transferring a count in the former to the latter as will be described hereinafter.

The sampling mode continues until the sampling electric switch 78' is opened as the sheets in the stack push the backstop past the end of the sampling area. The sampling AND gating circuit 106 is then disabled and the metering AND gating circuit 118 is actuated. The count in the incrementing counting circuitry is not disturbed in the metering mode. The reversible counting circuit may have any count from 1 to N−1 at the transition between the sampling and metering modes. Therefore, a load pulse is entered through an OR gating circuit 132 and an AND gating circuit 134 which is enabled by the erect Q output of the flip-flop circuit 102.

A differentiating circuit 136 is connected between the Q output terminal of the flip-flop circuit 102 and the OR gating circuit 132 to produce a positive going pulse at the setting of the flip-flop circuit 102 only whereby the number in the incrementing counting circuitry 100 is immediately loaded into the bidirectional counting circuitry 120 ready to begin the metering mode. The output of the differentiating circuit 136 is also applied to the OR gating circuitry 110 to insure that the backstop 55 is free to move at this time.

Those skilled in the art will recognize that such differentiating circuits are unnecessary with many flip-flop and like bilevel output circuits, but are desirable with other such circuits for producing a large sharp pulse on transitions and thereafter not affecting the gating circuits.

In the metering mode, the pulses corresponding to the sheets entering the stacker, which pulses appear at the output of the amplifying circuit 122 decrement the reversible counter to zero. This frees the backstop and reloads the increment number from the incrementing counting circuitry 100 to the counting circuitry 120 and so on as long as the documents are presented.

The operation in the metering mode is not disturbed by removal of documents from the stack unless the backstop is allowed to return into the sampling area. In this case, the sampling switch 78' will be reclosed. An indication of this condition is given by the operation of an AND gating circuit 140 and an inverting circuit 142 and presented on output terminals 144.

If the backstop should be allowed to go back even further into the starting area and close the starting switch 74', the complete cycle of operations must be gone through as this condition is the same as that where sheets of different thickness are to be used.

While the invention has been shown and described with reference to a single specific embodiment thereof, it should be clearly understood that those skilled in the art will make changes without departing spirit and scope of the invention as defined in the appended claims concluding the specification.

The invention claimed is:

1. Apparatus for stacking documents in sequence, comprising a bed assembly on which said documents are to be stacked, a backstop assembly slidably arranged on said bed assembly, a backplate assembly arranged at one side of said backstop assembly, electric circuit components on said bed assembly and on said backstop assembly arranged at a spacing proportional to a predetermined initial increment of stacking space located between said backplate and said backstop assemblies, a sensing assembly for detecting the entrance of a document into the space between said backstop and backplate assemblies, an escapement assembly arranged on said bed assembly and coupled to said backstop assembly for alternatively fixing and freeing said backstop assembly with respect to said bed assembly and having an electric control element for actuating said escapement assembly, an electric control signal generating circuit arrangement having input terminals connected to said electric circuit components, output terminals connected to said escapement control element, and other input terminals connected to said sensing assembly, and circuitry intermediate said terminals for counting a series of said documents entering the stacking space between said backstop assembly and said backplate assembly within said initial increment of stacking space, for storing said count for use in each succeeding incrementing of said backstop assembly, and for actuating said escapement assembly for subsequent incrementing of said backstop assembly along said bed assembly.

2. Apparatus for stacking documents in sequence as defined in claim 1, and incorporating a plurality of belts arranged on wheels assembled on said bed assembly for movement in the direction in which said stacking space is expanded, said escapement assembly being coupled to at least one of said wheels, and said backstop assembly being selectively fixed onto said belts, whereby said escapement assembly alternatively fixes and frees said belts and said backstop assembly with respect to said bed assembly.

3. Apparatus for stacking documents in sequence as defined in claim 2, and wherein said belts are endless flexible racks and at least said one wheel coupled to said escapement assembly is a pinion wheel.

4. Apparatus for stacking documents in sequence as defined in claim 3, and wherein said belts have spurring on both sides and said backstop assembly comprises pinion gearing arranged for free rotation in but one direction on one side of said belts.

5. Apparatus for stacking documents in sequence as defined in claim 4, and wherein said belts are arranged on said bed assembly in location where the lower edges of the documents in the stack are held in the spurring and thereby prevented from slipping in the direction of travel of said belts.

6. Apparatus for stacking documents in sequence as defined in claim 3, and wherein said escapement assembly comprises an escapement device at least including a ratchet wheel coupled to said escapement pinion wheel, a pawl having two pallets for engaging said retchet wheel and a pivot pin arranged on said bed assembly, an electromagnet arranged on said bed assembly and having an armature coupled to said pawl and a solenoid winding for connection to said electric control signal generating circuit arrangement.

7. Apparatus for stacking documents in sequence as defined in claim 6, and wherein said escapement device is dimensioned for two conditions of engagement of one or the other pallet with said ratchet wheel.

8. Apparatus for stacking documents in sequence as defined in claim 7, and wherein said escapement device is dimensioned for a predetermined increment of advance of said backstop.

9. Apparatus for stacking documents in sequence as defined in claim 2 and incorporating a negator spring assembly connected between said backstop assembly and said bed assembly for urging said backstop assembly towards said backplate assembly.

10. Apparatus for stacking documents in sequence as defined in claim 1, and wherein said backplate assembly comprises mechanical devices which are arranged for feeding documents into said stacking space and for moving the upper edges of said documents forward into the stacking space.

11. Apparatus for stacking documents in sequence as defined in claim 10, and wherein said backplate assembly is arranged for vertical positioning with respect to said bed assembly, whereby documents of differing heights are accommodated.

12. Apparatus for stacking documents in sequence as defined in claim 1, and wherein said backplate assembly comprises a toeplate arranged in near proximity to said bed assembly, and a pair of eccentric cams arranged on said backplate assembly for urging the bottom edges of said documents forward in said stacking space.

13. Apparatus for stacking documents in sequence as defined in claim 1, and wherein said electric circuit components comprise a pair of permanent magnets and associated reed switches arranged for indicating an initial position of said backstop and backplate assemblies and for indicating a predetermined increment of relative travel one from the other.

14. Apparatus for stacking documents in sequence as defined in claim 13, and wherein one of said permanent magnets is longer than the other on the order of said predetermined increment of said documents toward said backstop assembly.

15. Apparatus for stacking documents in sequence as defined in claim 1 and wherein said electric control signal generating circuit arrangement comprises incrementing counting circuitry having reset, incrementing and count outputting terminals, bidirectional counting circuitry having incrementing and decrementing count inputting, resetting, and count outputting terminals, loading gating circuitry having input terminals connected to said count outputting terminals of said incrementing counting circuitry, a gating actuating terminal, and output terminals connected to said count inputting terminals of said bidirectional counting circuitry, driving circuitry having input terminals coupled to at least one of said count outputting terminals of said bidirectional counting circuitry, and having output terminals connected to said escapement control element, and having a connection between one of said count outputting terminals of said bidirectional counting circuitry and said incrementing terminal of said incrementing counting circuitry, and gating circuitry connected to at least one of said electric circuit components and to said reset terminals of said incrementing counting circuitry for resetting the same, connected to said sensing assembly and to said incrementing terminals of said bidirectional counting circuitry for incrementing the same, connected to at least another of said electric circuit components and to said input terminals of said loading gating circuitry for translating a count in said incrementing counting circuitry into a count in said bidirectional counting circuitry, and connected to said electric circuit components and to said decrementing terminals of said decrementing counting circuitry for decrementing the latter for outputting from said one count outputting terminal to said driving circuitry.

16. Apparatus for stacking documents in sequence, comprising a bed assembly on which said documents are to be stacked, a backstop assembly slidably arranged on said bed assembly, a backplate assembly arranged at one side of said backstop assembly, a sensing assembly comprising a photosensitive device for detecting the entrance of a document into the space between said backstop and backplate assemblies, electric switch assemblies spaced apart and arranged on said bed and backstop assemblies and having electric contact elements for indicating first, second and third modes when in the respective conditions of at least two spaced contact elements in one state, two spaced contact elements in unlike states, and two spaced contact elements in another state opposite said one state, an escapement assembly arranged on said bed assembly and coupled to said backstop assembly for alternatively arresting and freeing said backstop assembly with respect to said bed assembly and having an electric control element for operating the assembly, an electric control circuit arrangement comprising input terminals connected to said photosensitive device, terminals connected to said electric switch assemblies and output terminals connected to said electric control element, and counting circuitry connected to said photosensitive device and to said electric switch assemblies for counting the number of sheets in said second mode, for storing a number proportional to said number, for decrementing said number proportional to said count in response to said photosensitive device in said third mode, each such decrementing of said number resetting said counting circuitry and delivering a control pulse at said control circuit output terminals.

17. Apparatus for stacking documents in sequence as defined in claim 16 and wherein said counting circuitry comprises incrementing counting circuitry having a reset terminal connected to an electric contact element of one of said electric switch assemblies, an incrementing terminal, and count outputting terminals, bidirectional counting circuitry having incrementing and decrementing input terminals, count input terminals, count input terminals, reset terminals and count output terminals, loading gating circuitry having actuating input terminals, having input terminals connected to said count outputting terminals of said incrementing counting circuitry and having output terminals connected to said count inputting terminals of said bidirectional counting circuitry, a bilateral flip-flop circuit having a set terminal, a reset terminal connected to said one electric contact element of said switch assemblies, an erect output terminal, and an inverted output terminal, one AND gating circuit having an output lead connected to said actuating input terminals of said loading gating circuitry, one input lead coupled to said erect output terminal of said bilateral flip-flop circuit and another lead coupled to a zero outputting terminal of said bidirectional counting circuitry, another AND gating circuit having an output lead connected to said incrementing terminal of said bidirectional counting circuitry, one input lead coupled to an electric contact element of the other of said electric switch assemblies, another input lead connected to said inverted output terminal of said flip-flop circuit and a further input lead connected to said photosensitive device, an additional AND gating circuit having an output lead connected to said decrementing terminal of said bidirectional counting circuitry, one input lead connected to said erect output terminal of said flip-flop circuit, another input lead and a further input lead connected to said photosensitive device, and an inverting circuit connected between said other electric contact element and said other input lead of said additional AND gating circuit.

18. Apparatus for stacking documents in sequence as defined in claim 17 and incorporating an OR gating circuit having an output lead coupled to said electric control element, one input lead coupled to said erect output terminal of said bilateral flip-flop circuit, another input terminal connected to said zero output terminal of said bidirectional counting circuitry and another input lead connected to another output terminal of said bidirectional counting circuitry.

19. Apparatus for stacking documents in sequence, comprising a bed assembly on which said documents are to be stacked, a backstop assembly slidably arranged on said bed assembly, a backplate assembly arranged at one side of said backstop assembly, a light source and photosensitive device assembly for detecting the entrance of a document into the space between said backstop and backplate assemblies, one electric switch and an actuator therefor arranged on said bed and backstop assemblies, and another electric switch and an actuator therefor arranged on said bed and backstop assemblies with both switches closed in a first mode, said one switch open and said other switch closed in a second mode, and both switches open in a third mode, an escapement assembly arranged on said bed assembly and coupled to said backstop assembly for alternatively arresting and freeing said backstop assembly with respect to said bed assembly and having an electric solenoid control element for operating the assembly, a bilateral flip-flop circuit having a reset terminal connected to said one switch, a set terminal and complementary erect and inverted output terminals, incrementing counting circuitry having a reset terminal connected to said one electric switch, an incrementing terminal, and count outputting terminals, bidirectional counting circuitry having incrementing and decrementing input terminals, count input terminals, reset terminals and count output terminals including at least one predetermined zero and another predetermined other than zero count output terminals, loading gating circuitry having an actuating input terminal, having input terminals connected to said count outputting terminals of said incrementing counting circuitry and having output terminals connected to said count input terminals of said bidirectional counting circuitry, another AND gating circuit having an output lead connected to said actuating input terminal of said loading gating circuitry, one input lead connected to said erect terminal of said flip-flop circuit and another lead coupled to said predetermined zero outputting terminal of said bidirectional counting circuitry, a futher AND gating circuit having an output lead connected to said incrementing terminal of said bidirectional counting circuitry, one input lead connected to said inverted output terminal of said bilateral flip-flop circuit, another input lead connected to said other electric switch and a further input lead connected to said photosensitive device, an additional AND gating circuit having an output lead connected to said decrementing terminal of said bidirectional counting circuitry, one input lead connected to said erect output lead of said bilateral flip-flop circuit, another input lead and a further input lead connected to said photosensitive device, an inverting circuit having an input lead connected to said other electric switch and an output lead connected to said other input lead of said additional AND gating circuit and coupled to said set terminal of said bilateral flip-flop circuit, and an OR gating circuit having an output lead for coupling to said electric solenoid control element, one input lead connected to a differential circuitry connected in turn to said erect output terminal of said bilateral flip-flop circuit, another input terminal connected to one of said predetermined output terminals of said bidirectional counting circuitry and another input lead connected to another output terminal of said bidirectional counting circuitry.

20. Apparatus for stacking documents in sequence as defined in claim 19 and incorporating a monostable flip-flop circuit and a solenoid driving circuit interposed in series between said OR gating circuit and said output lead for coupling to said solenoid control element.

* * * * *